US007413009B2

(12) United States Patent
Jacobs et al.

(10) Patent No.: US 7,413,009 B2
(45) Date of Patent: Aug. 19, 2008

(54) SYSTEM AND METHOD FOR PUMPING FLUIDS

(75) Inventors: Christopher A. Jacobs, Midland, TX (US); James C. Henry, Midland, TX (US)

(73) Assignee: Henry Research and Development LLC, Midland, TX (US)

( * ) Notice: Subject to any disclaimer, the term of this patent is extended or adjusted under 35 U.S.C. 154(b) by 390 days.

(21) Appl. No.: 11/282,442

(22) Filed: Nov. 17, 2005

(65) Prior Publication Data

US 2007/0110598 A1 May 17, 2007

(51) Int. Cl.
*E21B 43/00* (2006.01)

(52) U.S. Cl. ..... 166/105; 417/415

(58) Field of Classification Search ..... 166/68, 166/68.5, 105; 417/397, 415
See application file for complete search history.

(56) References Cited

U.S. PATENT DOCUMENTS

| | | | | |
|---|---|---|---|---|
| 1,842,457 | A | 1/1932 | Mendenhall et al. | |
| 3,397,643 | A | 8/1968 | Jepsen | |
| 4,417,860 | A | 11/1983 | Justice | |
| 4,548,552 | A | 10/1985 | Holm | |
| 4,687,054 | A | 8/1987 | Russell et al. | |
| 4,696,221 | A * | 9/1987 | Dollison | 91/51 |
| 4,768,595 | A | 9/1988 | Smith | |
| 5,785,122 | A | 7/1998 | Spray | |
| 5,992,517 | A | 11/1999 | McAnally | |
| 6,086,339 | A | 7/2000 | Jeffrey | |
| 6,089,316 | A | 7/2000 | Spray | |
| 6,155,792 | A | 12/2000 | Hartley et al. | |
| 6,298,914 | B1 | 10/2001 | Spray et al. | |
| 6,379,119 | B1 * | 4/2002 | Truninger | 417/22 |
| 6,454,542 | B1 * | 9/2002 | Back | 417/53 |

OTHER PUBLICATIONS

"Mechanical Release Type GS Pulling Tool," CoilTOOLS Catalog, Schlumberger, USA.

* cited by examiner

*Primary Examiner*—William P Neuder
(74) *Attorney, Agent, or Firm*—Locke Lord Bissell & Liddell LLP

(57) ABSTRACT

The system and method of the present invention includes an electrical to mechanical converter (EMC), such as a motor, and a hydraulic pump-and-cylinder arrangement that is connected to the electrical to mechanical converter for input, and to a sucker rod pump for output, in at least one embodiment. The entire assembly can be deployed below the level of the well fluid in a well. The EMC-driven hydraulic pump and cylinder can provide reciprocating linear motion to operate the sucker rod pump. In contrast, this linear motion is normally provided by sucker rods connected to a plunger inside a pump barrel and a pumping unit on the surface. The invention provides the required linear motion for the sucker rod pump to operate, but without the need for sucker and a surface pumping unit.

49 Claims, 11 Drawing Sheets

SYSTEM AND METHOD FOR PUMPING FLUIDS

FIELD OF THE INVENTION

The invention relates to the pumping of fluids. More specifically, the invention relates to a system and method for pumping fluids in a well.

BACKGROUND OF THE INVENTION

One of the most robust and dependable pieces of equipment in the oil extraction industry, commonly referred to as oil pumping, is the sucker rod pump. The sucker rod pumping system described is by far the most widely used of any artificial lift system. To simply describe the operation of the sucker rod pump is to describe the pumping cycle. Typically, a plunger inside a pump barrel of the sucker rod pump starts the upstroke actuated by the sucker rod, which in turn is actuated by a pumping unit on the surface. The weight of the liquid above the plunger will cause a one-way check valve, known as a "traveling valve," to close. Typically, the traveling valve is part of the plunger and, thus, travels with movement of the plunger. The upward motion of the plunger ("upstroke") will cause a reduction in pressure below the plunger in the lower portion of the pump. The pressure of the standing column of oil outside the pump will cause the oil to flow into a void in the lower portion of the pump created by the upstroke through another one-way check valve, known as a "standing valve."

As the motion of the plunger is reversed and the plunger starts downward ("downstroke"), the standing valve becomes closed. The pressure below the plunger increases and the traveling valve is opened. The fluid that previously entered through the standing valve flows upward through the traveling valve and into an upper portion of the pump above the plunger. On the next upstroke, the plunger displaces this fluid into the tubing above the pump. On successive cycles, an increment of fluid is displaced into the tubing, and eventually is discharged at the surface for further processing.

FIG. 1 is a schematic diagram of a prior art sucker rod pumping system. The figure illustrates one typical system by which produced fluids in a well are currently pumped from a subsurface depth of a well to the surface. The well generally includes a casing 12 installed into a well bore drilled into the earth and a conduit 15, generally termed "tubing," inserted into the casing for flowing fluids therethrough. One or more perforations 13 are formed in the casing to allow production fluids to enter the interior of the casing and be pumped to the surface. A sucker rod pump 30A, particularly an inlet of the pump, is installed below a fluid level 20 of the well so that fluid can enter the sucker rod pump and be pumped to the surface of the well through outlet 41 for further processing. A rod 24A, called the "thrusting rod," protrudes from the sucker rod pump axis.

A pumping unit 3 pivots rotationally, as shown by the curved motion arrows. This rotational pivoting action is leveraged into an up-and-down motion via one or more cables 6 from the pumping unit 3. The cables 6 are connected to a polish rod, which is connected to at least one sucker rod 9. An assembly of sucker rods creates a sucker rod string of a certain length. The up-and-down motion of the pumping unit is transmitted down the well through the sucker rods 9 to the sucker rod pump 30A.

As can be seen within the cutaway outline 18, the sucker rod 9 transmits its thrusting action via a joiner 21 to the rod 24A of the sucker rod pump 30A. The sucker rod is prone to failure. The failure can be attributed to a number of causes, but the repair of the rod string to return the well to operational status presents high costs to the operator. Not only is the cost of the equipment to be repaired significant, but the well servicing rig to pull and repair the sucker rod string represents a large portion of the repair. Further, when sucker rod wear on the interior of the tubing creates a leak in the tubing, that tubing must be repaired and tested to ensure integrity. The well servicing costs associated with sucker rod breaks and tubing leaks are a large part of the significant costs associated with rod pumped well failures.

A plunger (not shown) is coupled to the rod 24A inside the sucker rod pump 30A. The plunger has one or more one-way check valves (not shown), commonly called "traveling valves". As the rod 24A drives the plunger down in the downstroke, well fluid flows through these check valves. Once having flowed through these check valves, the well fluid is now in or on the top of the plunger. When the rod 24A downward motion reverses into an upstroke, the plunger lifts the well fluid up through a second set of one-way check valves 36, commonly called "standing valves," into the tubing 15. Also, as the plunger rises, well fluid is drawn into the lower part of the sucker rod pump via the inlet holes 33A. This same well fluid will move above the plunger on the plunger's downstroke.

Once well fluid is in the tubing 15, the one-way check valves 36 prevent the well fluid from returning into the sucker rod pump 30A. Additional well fluid is pumped into the tubing 15 with repeated cycles. With each new cycle, well fluid 39 is raised higher, eventually flowing to the surface and out the outlet 41 for further processing. This is the basic description of the prior art as to how well fluid is currently pumped from an oil well.

When the proper reciprocating linear motion is provided, this method of using a rod pump to pump fluid is dependable and has longevity. Longevity is important for components installed in an oil well, because the component may have to be brought to the surface from depths that may exceed a mile. Such operations are typically very costly from the service and from downtime in production.

Presently, the major disadvantage of a sucker rod pump system is that the linear force to drive the pump is from sucker rods emanating from the surface, which is often over a mile above the sucker rod pumps. These rods can weigh from one to three pounds per foot of depth and can easily weigh upwards of eight tons in many applications. Importantly, these tons of rods must not only be continuously supported, but their direction must be reversed for every stroke of fluid pumped.

The procedure is inefficient and requires a substantial energy input due to the frictional losses of the rods rubbing against the tubing in which they are encased, and the bearings of the pumping unit that have to rotate while under this constant support pressure. Also, the pumping unit, required to generate the reciprocating motion, is expensive and dangerous. Environmentalist groups claim that the pumping unit, which stands 25-40 feet high, is an eye sore. Further, surface pumping equipment, such as the pumping unit 3, can present problems in agricultural areas, because of the surface area required as well as vertical obstacles in farmlands where surface ground traversing irrigation systems are used.

There are other methods of artificial lift such as submersible centrifugal pumps, progressive cavity pumps, gas lift, and hydraulic pumping. The submersible centrifugal pumps are normally used for high volume applications, where the volume to be lifted exceeds rod pumping capabilities. These electrically driven centrifugal pumps utilize a series of impellers, which converts the centrifugal force on the fluid into pressure. Progressive cavity pumps are positive displacement pumps that can be driven by shafts rotated by motors on the surface, while some are actuated by submersible motors. Gas lift pumping utilizes natural gas as a lift mechanism either through continuous flow, intermittent flow, or plunger lift methods. Hydraulic pumping uses pumps on the surface to pressurize liquids, such as oil, to activate the downhole pump. Each type has its applications, but also problems unique to each type.

One significant problem that these other artificial lift technologies generally encounter is the high capital cost and excessive operating expenses when lifting low volume producing wells. This technology is unsuitable for most wells presently in operation in the United States, which produce less than 50 barrels of oil and water per day. Another problem is the life of the equipment or the duration of service without major maintenance, which, while quite short, may be acceptable for high volume applications that can justify expensive maintenance.

Another design idea has been proposed that includes a motor down in the well near the fluid level, where the motor can turn a threaded shaft upon which a nut-like assembly is attached. As the threaded shaft rotates, the nut-like assembly moves linearly up the shaft. This nut-like assembly is connected to the input rod of the rod pump. The direction of rotation of the threaded shaft is reversed when the chamber of the rod pump is at its largest. Then, the nut-like assembly will move down the threaded shaft, forcing the input rod back into the rod pump and the chamber size will shrink, thereby pumping the fluid. The motor can continue to alternate reversing its rotation to reverse the rotation of threaded shaft to continue to pump the fluid.

While the nut on thread process may be theoretically possible, there are several drawbacks in its practical implementation. First, this mechanism wears out relatively quickly, far short of the required number of reciprocations for a standard well, even using ball bearings in the threaded nuts. The second failing is that a motor which can reverse direction is inherently less efficient, more expensive, and more maintenance prone. The goal of a low maintenance system over the life of the well is compromised.

Thus, there remains a need for an improved pumping system that targets low volume applications with low capital investment and long life between repairs.

SUMMARY OF THE INVENTION

The present invention provides a linear thrusting and pulling motion used to operate a linear displacement pump, such as a sucker rod pump, independent (that is, without the need) of a sucker rod extending down from a surface pumping unit. The system is particularly applicable to low volume applications where alternative lift technologies may be commercially prohibitive. In the most standard application, a sucker rod pump is mounted vertically within a well generally below a well fluid level and attaches to and discharges well fluid into a tubing that extends to the surface of the well. A hydraulic cylinder with a cylinder rod coupled to a corresponding rod of the sucker rod pump, provides the up-and-down motion to force the sucker rod pump to discharge well fluid into the tubing to be conducted to the well surface. A piston coupled to the cylinder rod forms a tight seal against the hydraulic cylinder. When hydraulic fluid is pumped into an upper inlet port on the hydraulic cylinder above the piston, the piston is forced down within the cylinder. When hydraulic fluid is pumped into a lower inlet port on the hydraulic cylinder below the piston, the piston moves up within the cylinder. As the piston moves, the cylinder rod moves and reciprocates the sucker rod pump to pump the well fluid.

The power source for the hydraulic cylinder includes an electrical to mechanical converter ("EMC") such as an electric motor or solenoid, and a hydraulic pump coupled to the EMC. The EMC can provide mechanical energy to the hydraulic pump, such as by rotating an input shaft of the hydraulic pump, and the hydraulic pump can pump hydraulic fluid into the hydraulic cylinder. A return line from the hydraulic cylinder allows the hydraulic fluid to return to the hydraulic pump. Further, the system can include a switching unit, such as a hydraulic manifold, to reverse the fluid flow into the hydraulic cylinder, without necessitating reversal in rotation of the EMC or the hydraulic pump. Alternatively, the system can include a directional valve to direct the flows between the hydraulic pump and the hydraulic cylinder. Thus, pumping of the well fluid is achieved without the need for the surface pumping unit and the sucker rod widely used as an artificial lift method in the production of well fluids.

In at least one embodiment, the invention provides a system for pumping well fluid to an upper surface of a well, comprising: a sucker rod pump; hydraulic cylinder coupled to the sucker rod pump and adapted to impart linear motion to the sucker rod pump; a hydraulic pump coupled to the hydraulic cylinder and adapted to provide hydraulic fluid to the hydraulic cylinder; and an EMC coupled to the hydraulic pump and adapted to provide input power to the hydraulic pump.

The invention also provides a system for pumping well fluid to an upper surface of a well, comprising: a linear displacement pump; a hydraulic cylinder coupled to the linear displacement pump and adapted to impart reversible linear motion to the linear displacement pump; and a hydraulic pump coupled to the hydraulic cylinder and adapted to provide hydraulic fluid to the hydraulic cylinder.

The invention further provides a process for pumping well fluid to an upper surface of a well with a linear displacement pump, a hydraulic cylinder having a rod coupled to the linear displacement pump, a hydraulic pump coupled to the hydraulic cylinder, and an EMC coupled to the hydraulic pump, comprising: allowing the well fluid into the linear displacement pump; actuating the EMC to provide mechanical energy to the hydraulic pump; pumping hydraulic fluid with the hydraulic pump into a first port on the hydraulic cylinder to cause a piston in the hydraulic cylinder to move the hydraulic cylinder rod; opening a first valve of the linear displacement pump to allow well fluid to flow into a pump chamber of the linear displacement pump by movement of the hydraulic cylinder rod; and opening a second valve of the linear displacement pump to allow well fluid to flow out of the pump chamber of the linear displacement pump by movement of the hydraulic cylinder rod while restricting discharge of the well fluid through the first valve.

BRIEF DESCRIPTION OF THE DRAWINGS

A more particular description of the invention, briefly summarized above, can be realized by reference to the embodiments thereof that are illustrated in the appended drawings and described herein. However, it is to be noted that the appended drawings illustrate only some embodiments of the invention. Therefore, the drawings are not to be considered limiting of its scope, for the invention may admit to other equally effective embodiments.

DETAILED DESCRIPTION OF THE INVENTION

Figure 1:
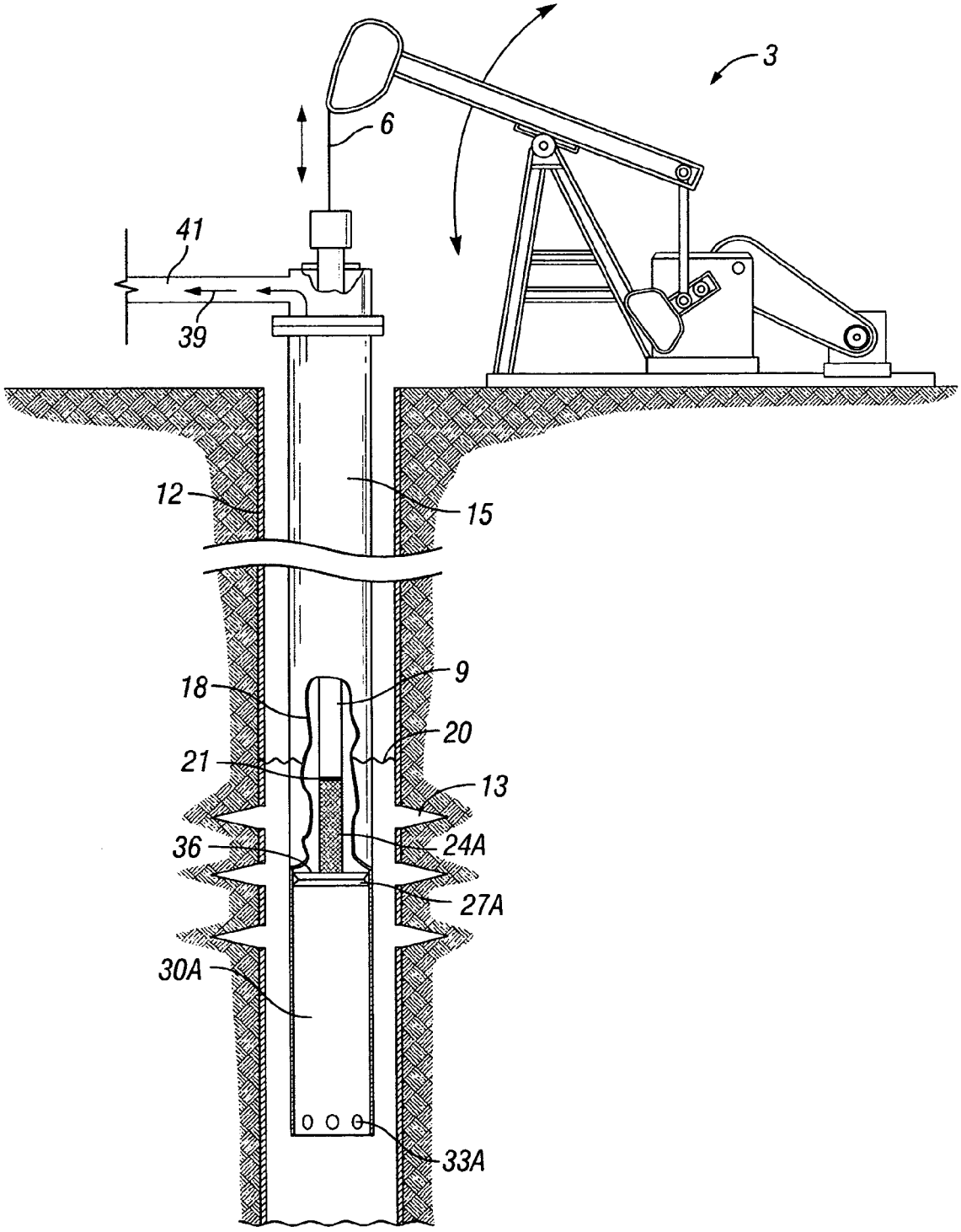
FIG. 1 (PRIOR ART)
FIG. 1 is a schematic diagram of a prior art sucker rod pumping system.

In the description that follows, like elements are marked throughout the specifications and drawings with the same reference numerals, respectively. The drawing figures are not to scale. The elements are generally shown in schematic form in the interest of clarity and conciseness.

Figure 2:
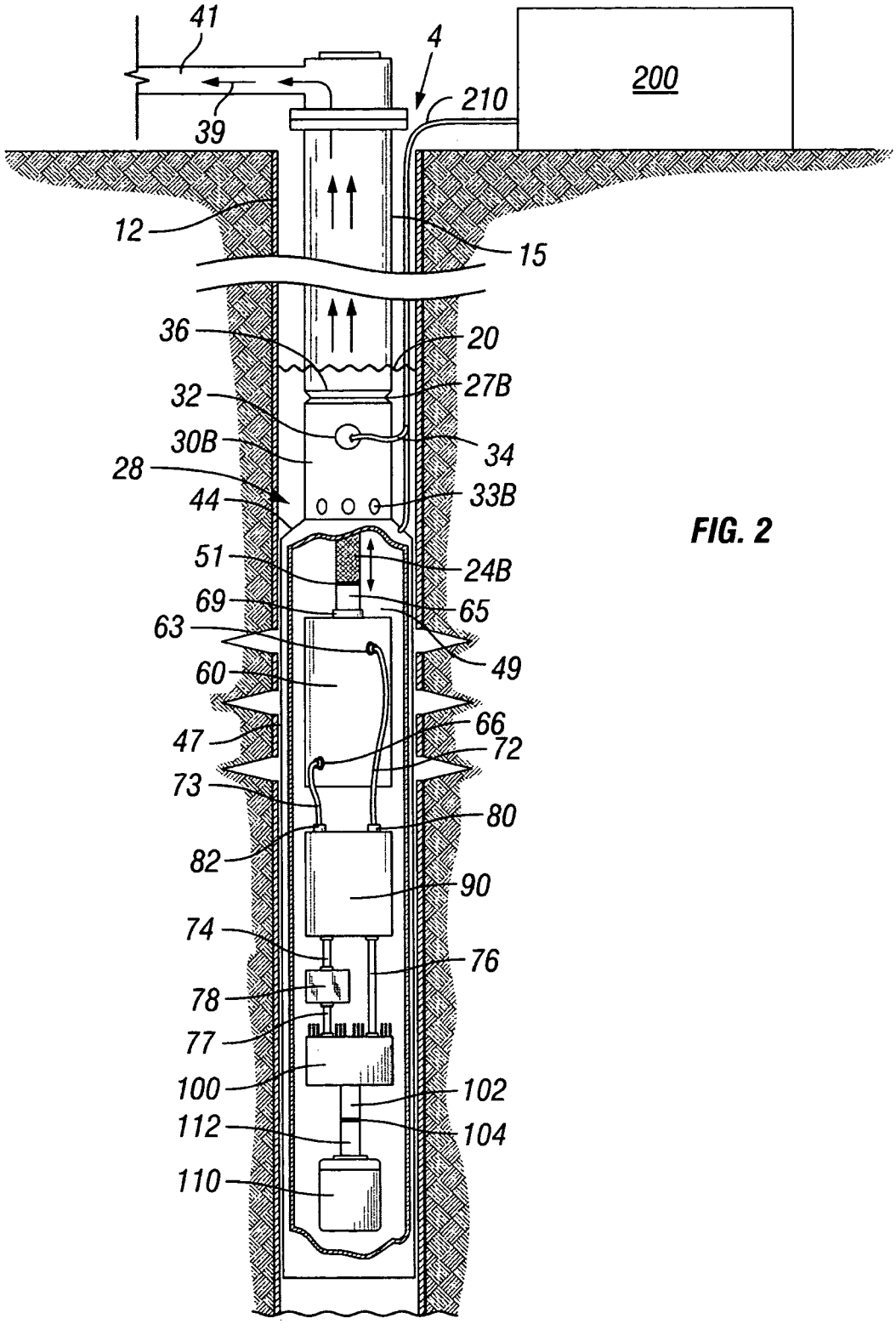
FIG. 2 is a schematic diagram of one embodiment of a pumping system of the present invention, using a sucker rod pump.

FIG. 2 is a schematic diagram of one embodiment of a pumping system 28 of the present invention, using a linear displacement pump, to illustrate exterior portions of major members of the present invention. The members are illustrated through a cutaway portion of an enclosure 47 that surrounds one or more members. Like the prior art, this embodiment of the pumping system 28 uses a sucker rod pump the same or similar to the industry standard sucker rod pump as the linear displacement pump. However, the pumping system generally also includes an EMC, such as a motor, a hydraulic pump operated by the EMC, and a hydraulic cylinder operated by fluid from the hydraulic pump to provide linear motion to the sucker rod pump in the manner described herein.

The functionality of the sucker rod pump's components stay the same, and the numbers used to designate these components will also remain the same; however, to indicate that these components are for a sucker rod pump with the rod generally coming out the bottom, the suffixes will be switched from "A" to "B" as in 30B. Other orientations are possible.

A well 4 generally includes a casing 12 installed into a well bore drilled into the earth and a tubing 15 inserted into the casing for flowing fluids therethrough. The tubing can be production tubing, coiled tubing, piping or other types of conduit or various shapes and flexibility having a flow path. When the tubing is constructed of non-electrically conductive material, such as plastic, viable options are to embed the elements of a cable 210 into the walls of such tubing. The cable 210 can be used for power and/or information transmission for the various power elements, such as motors, solenoids, and actuators, and/or control elements, such as sensors, described herein. In contrast to adhering the cable 210 to the outside of the tubing, or running the cable 210 in a separate channel, embedding this cable can assist in retaining the smoothness on the external surfaces of the tubing and reduce its overall outside dimension and space requirements for the cable in the well.

A sucker rod pump 30B, particularly an inlet 33B of the pump, is installed below a fluid level 20 of the well, so that fluid can enter the sucker rod pump and be pumped to the surface of the well through outlet 41 for further processing. The sucker rod pump 30B can be coupled to the tubing 15 by a connector 27B. The term "fluid" for the produced fluid from the well is used broadly herein, and includes a liquid primarily composed of crude oil and water, which naturally comes from the earth in a producing oil well. However, well fluid can include other liquids and gases, depending on the purpose of the well. The term "coupled," "coupling," and like terms are used broadly herein and can include any method or device for securing, binding, bonding, fastening, attaching, joining, inserting therein, forming thereon or therein, communicating, or otherwise associating, for example, mechanically, fluidicly, magnetically, electrically, chemically, directly or indirectly with intermediate elements, one or more pieces of members together and can further include integrally forming one functional member with another. The coupling can occur in any direction, including rotationally.

The sucker rod pump generally is of a tubing pump configuration, where the barrel of the pump is the wall of the tubing with the plunger of the pump acting within the wall of the tubing, as described below. Other embodiments are possible. For example, where a wireline retrievable pump is desired, an insert type sucker rod pump could be run inside the tubing and set in a landing nipple. An insert type pump is one with the outside diameter of the pump barrel being smaller than the inside diameter of the tubing. Further, some sucker rod pumps are double acting and pump fluid in both the upstroke and downstroke and are included within the scope of the invention.

While it is contemplated that a sucker rod pump is generally commercially suitable to the present invention, it is to be understood that other types of pumps are applicable, whether commercially available or customized. In general, a pump that can pump from a lower elevation to a higher elevation by actuation in a reversing linear direction, as a linear displacement pump, would be suitable for the present invention.

A rod 24B can extend from the bottom of the sucker rod pump 30B. The rod 24B can be coupled to a hydraulic cylinder 60. The hydraulic cylinder 60 has a rod 65, which is coupled by a joiner 51 to the rod 24B. The hydraulic cylinder 60 is adapted to drive the sucker rod pump 30B. The hydraulic cylinder is generally fixed relative to the sucker rod pump. For example, the pump and cylinder can be fixedly coupled to the enclosure 47 to limit relative movement or can be coupled directly to each other and only one element fixed to some relatively stationary component. When the rod 65 of the hydraulic cylinder 60 moves upward, the rod 24B of the sucker rod pump is thereby forced upward and lifts well fluid. The well fluid travels through discharge valves ("standing valves") into the tubing 15, as with the more conventional sucker rod pump 30A. The well fluid builds with successive repetitions to create a fluid flow 39 that can exit the well at an outlet 41 for further processing. When the rod 65 moves downward, the rod 24B is pulled downward, drawing well fluid into the sucker rod pump 30B. This arrangement avoids the need for an extended sucker rod, such as rod 9 that is operated from a pumping unit 3 at the ground surface, described in reference to FIG. 1.

The hydraulic cylinder 60 can be actuated by hydraulic fluid flow through two hydraulic conduits 72, 73. For example, the hydraulic conduit 72 can be coupled to an upper port 63 and the hydraulic conduit 73 can be coupled to a lower port 66. The ports can be located at appropriate positions on the hydraulic cylinder including on the side and ends of the cylinder. The hydraulic conduits provide hydraulic fluid to and from the hydraulic cylinder 60, depending on the direction of movement of a piston in the cylinder in a manner known to those with ordinary skill in the art. The hydraulic fluid used to operate the hydraulic cylinder by way of the hydraulic pump is generally a separate fluid from the produced fluid and flows through a closed loop system.

The two hydraulic conduits are coupled at a distal end from the hydraulic cylinder to a hydraulic manifold 90. The hydraulic manifold 90 is used to establish a reversing of fluid flow in the hydraulic system. The hydraulic conduits 72, 73 can be coupled to two manifold ports 80, 82, respectively, on the manifold 90. For example, when the manifold 90 discharges hydraulic fluid from manifold port 80 into the upper port 63 on the hydraulic cylinder, a piston (shown in FIG. 6) in the hydraulic cylinder 60 moves down, thereby pulling the plunger of the sucker rod pump down. Conversely, when the manifold 90 discharges hydraulic fluid from manifold port 82 into the lower inlet port 66 on the hydraulic cylinder, the hydraulic cylinder piston moves up, thereby pushing the plunger of the sucker rod pump up.

When the sucker rod pump plunger is at the top of its travel, the manifold 90 can be instructed to stop discharging hydraulic fluid into the manifold port 82 and start discharging hydraulic fluid into the manifold port 80 to reverse the flow. While it would be obvious to one skilled in the art, for purposes of completeness it can be said that when the manifold 60 is outputting fluid into either of the hydraulic cylinder ports, it is receiving fluid back into itself from the hydraulic cylinder opposing port. This up and down action is continued as long as pumping action is desired.

The hydraulic manifold 90 generally steers hydraulic fluid in the system. The actual pumping for the hydraulic fluid is provided by a hydraulic pump 100, which converts rotary motion on its input shaft into hydraulic fluid pumping. Commercially available hydraulic pumps suitable to the pressure, temperature, and duty cycle are available.

A reservoir 78 for the hydraulic fluid can be useful to assure a sufficient quantity of the fluid for the hydraulic pump and hydraulic cylinder. The reservoir 78 can be coupled to the system at various portions, such as upstream of the pump 100 or between the hydraulic cylinder 90 and the pump 100. Various hydraulic conduits can be used to fluidicly couple the pump 100 to the cylinder 90 and/or reservoir, as may be suitable, such as conduits 74, 76, 77.

An electrical to mechanical converter (EMC) 110, such as a motor or solenoid, can provide mechanical energy to the hydraulic pump 100. In general, the EMC is a device that converts electrical energy to mechanical motion to actuate another device coupled thereto. In at least one embodiment, the EMC 110 can include a motor to provide rotational motion. The EMC 110 can be supplied with power from the cable 210. The cable 210 can be connected to a pumping controller 200 situated at some appropriate location, such as on the surface of the well. In at least one embodiment, the EMC 110 can include a power output shaft 112 that can be coupled with a joiner 104 to an input shaft 102 of the hydraulic pump 100 to effect a transmission of power. The joiner 104 can be a direct coupling or an indirect coupling, such as a gearbox or other transmission that adjusts the relative revolutions between the pump and the EMC. Thus, the EMC can provide rotary motion to the input shaft 102 of the hydraulic pump 100.

Generally, it is advantageous to restrict the entry of well fluids into the EMC, especially as the downhole EMC 110 is expected to be submerged in the well fluids. A seal section can utilize bag and labyrinth seals to seal a shaft through its center that is connected to the EMC shaft. In addition to protecting the EMC from well fluids, the seal section also serves to a) provide a reservoir for any EMC oil expansion and contraction caused by temperature and pressure changes, b) equalize the internal pressure of the EMC with the pressure in the well, and c) contain thrust bearings. Protruding upward from the seal section will be a shaft transferring the rotary motion from the EMC to components above.

One or more of the components described above can be enclosed by an enclosure 47 to protect components of the present invention from downhole conditions in the well. The enclosure 47 can be coupled to the sucker rod pump 30B by a transition portion, such as a joiner 44. In some embodiments, the joiner 44 can also form a seal between the adjacent components. Such components to be enclosed can include the hydraulic cylinder 60, the manifold 90, the reservoir 78, the hydraulic pump 100, and the EMC 110 with associated components, such as joiners and conduits. Further, various seals can be appropriate, such as seal 69 for the hydraulic rod 65 and other seals, as would be known to those with ordinary skill in the art.

Figure 3:
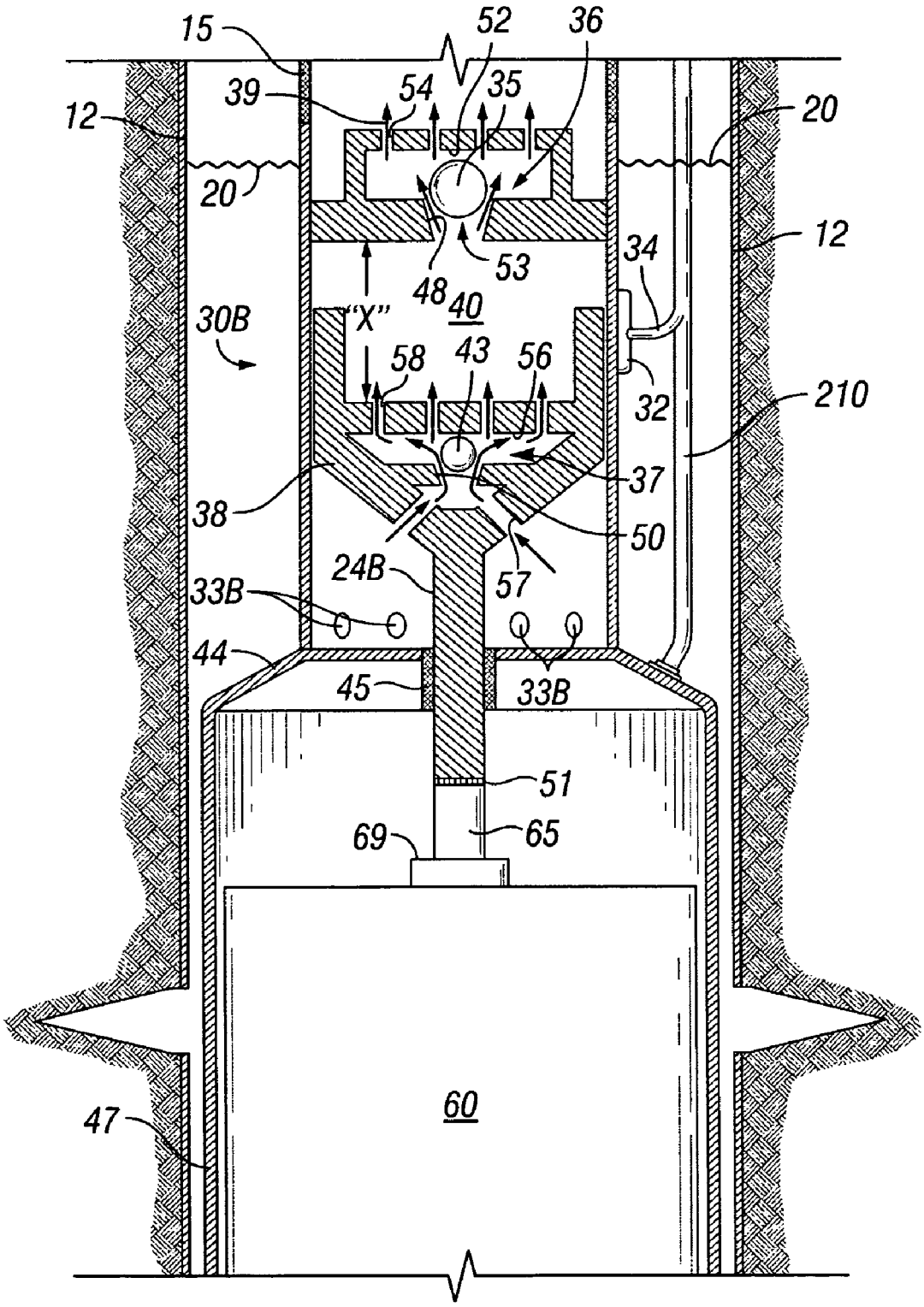
FIG. 3 is a schematic cross-sectional diagram of a portion of one embodiment of the pumping system of FIG. 2, illustrating a rod for a sucker rod pump, two or more valves, and a hydraulic cylinder used to drive the sucker rod pump.

In one embodiment, the sucker rod pump 30B and enclosure 47 with the components contained therein can be coupled to the end of the tubing 15 and inserted down the casing 12, described in referenced to FIGS. 2 and 3. In other embodiments, the sucker rod pump and enclosure can be inserted through the tubing 15 to a predetermined location and be retrievable without necessitating pulling the tubing.

The method of the present invention, for linearly moving the sucker rod pump, has other advantages and conveniences over the traditional method of using rods and pumping units. For example, one of the problems in the use of a sucker rod pump is when the well fluid to be pumped out of the well gets below the inlet level of the sucker rod pump, thereby allowing the sucker rod pump to partially fill or draw in gas. The effectiveness of the sucker rod pump is dramatically reduced, possibly to the point of not pumping. One way in which partial filling is allowed into the sucker rod pump inlet is called "over pumping," which is a situation where so much well fluid is pumped out of the well so quickly that pumping out of the well exceeds the natural flow of well fluid into the well. The well fluid level is reduced below a critical level and falls below the sucker rod pump inlet. Further, gas can enter the exposed inlet and cause "pounding" on the sucker rod pump, reducing its life. To overcome this unfortunate situation, the well operator tries to predict the rate at which well fluid will flow into the well, and sets timers to turn the pumping unit off for sufficiently long each day for new well fluid to flow into the well. However, the predictive accuracy can be off and is usually a matter of trial and error until a satisfactory timing is found. If the pumping unit runs too long, the sucker rod pump will partially fill, as described above. If the pumping unit is set to run for too short a time, the well will not be producing at capacity, and money will be lost due to not enough oil pumped out of the well. Some surface controllers attempt to control the pump by indirectly measuring the fluid level, but are only partially effective.

The present invention can overcome this problem by use of a well fluid sensor 32 to regulate output from the sucker rod pump 30B. The well fluid sensor 32 can include a pressure sensor to sense pressure, such as a drop in pressure, pumping pressure, or fluid level to be pumped. The sensor can provide input to control the pump output, including shutting off the pump and restarting the pump. The sensor 32 can be mounted near the inlet of the sucker rod pump 30B, such that the well fluid conditions proximal to the sucker rod pump are generally known. The sensor 32 can be powered where appropriate by the cable 210 via cable 34, as well. Further, the sensor 32 can transmit and receive, if appropriate, information through an information transport cable 34 that can be bundled into the cable 210. The pumping can be optimized to get the maximum rate of well fluid extraction, but with less danger that the well fluid will fall below the level of the sucker rod pump inlet.

FIG. 3 is a schematic cross-sectional diagram of a portion of one embodiment of the pumping system of FIG. 2, illustrating a rod for a sucker rod pump, two or more valves, and a hydraulic cylinder used to drive the sucker rod pump. The figure illustrates the interaction between the hydraulic cylinder 60 and its rod 65 with the sucker rod pump 30B. The sucker rod pump 30B is coupled to the tubing 15 through which well fluid 39 flows. The sucker rod pump 30B includes a relatively stationary check valve 36, known as a standing valve, and a linearly movable check valve 37, known as a traveling valve. While only one of each valve type is shown, it is to be understood that the actual embodiment can have multiple valves. The traveling valve is generally disposed in a traveling portion of the pump, sometimes known as a plunger 38. The distance between the check valve 36 and the plunger 38 with the check valve 37 varies as "X" to form a variable volume pump chamber 40. The variation in chamber volume in cooperation with the check valves is used to pump the well fluid through the system.

The check valve 36 generally has a check ball 35 that seals in one direction by contacting a sealing surface, known as a seat 48. The seat is generally a precisely formed hole in a plate. The hole diameter is smaller then the diameter of the check ball to restrict the downward movement of the ball. The upward movement of the check ball 35 away from the seat 48 is restricted by a limiting surface 52. An inlet port 53 allows well fluid to enter the valve 36 and an outlet port 54 allows fluid to exit the valve 36. In general, when well fluid pressure below the valve becomes higher than above, the ball lifts, and well fluid flows through the valve. When well fluid pressure above the valve becomes higher than below, the ball engages the seat, closing the valve and preventing well fluid flow past the check ball.

Similarly, the valve 37 has a check ball 43 that can sealingly contact a seat 50. The upward movement of the check ball 43 away from the seat 50 is restricted by a limiting surface 56. An inlet port 57 allows well fluid to enter the valve 37 and an outlet port 58 allows fluid to exit the valve 37. Other types of check valves are possible and the principles of fluid flow through the sucker rod pump would be the same or similar.

The plunger 38 is coupled to the rod 24B of the sucker rod pump. The rod 24B is in turn coupled to an output rod 65 of the hydraulic cylinder 60 though a joiner 51.

An enclosure 47 can enclose all or a portion of the components, such as the hydraulic cylinder 60. The enclosure 47 can be coupled to the sucker rod pump 30B, for example, by a joiner 44. A seal 45 disposed around the rod 24B or rod 65 can assist in deterring impurities from entering the enclosure 47. Similarly, a seal 69 around the output rod 65 can maintain integrity for the hydraulic cylinder.

It is generally desirable for the proper operation of the pump 30B that the well fluid level 20 remain sufficiently higher than the inlet 33B of this pump 30B to avoid drawing in air above plunger 38 resulting in the above described "over pumping." In one embodiment, a well fluid sensor 32 is used to detect the well fluid level 20. The sensor 32 can indicate to a pumping controller 200, as shown in FIG. 2, via the information transport cable 34 bundled into the power/information cable 210, to stop the motion of the hydraulic cylinder 60 when the well fluid level 20 falls below a desirable well fluid level.

While sensing pressure to determine the desirable well fluid level 20 is described in one embodiment, it should be noted that there are alternate means of detecting well fluid levels such as, but not limited to, using two electrodes with a gap between them and applying a low voltage across the gap. Because well fluid conducts electricity several orders of magnitude better than gases, such as natural gas in the well, it can be determined when well fluid has fallen below the level of the electrode gap by the marked change in resistance across the gap. By setting this gap at the proper height above the pump's inlet 33B, the desirable well fluid level 20 can be set. Other methods are available and the two methods described are exemplary.

For describing the operation, a starting point is where the rod 65 is at the highest point in its travel. The sucker rod pump's plunger 38 is at its highest point and the sucker rod pump's chamber 40 is at a minimum. Theoretically, there is no flow through the sucker rod pump 30B and check valves 36, 37 are closed. As rod 65 starts its downward travel ("downstroke") pulling the plunger 38, the distance X between the standing check valve 36 and the plunger 38 with the traveling check valve 37 increases to expand the chamber volume. The pressure below the valve 37 becomes higher than the pressure above the valve. During this downstroke, the higher pressure below the valve allows the check ball 43 to disengage the seat 50, thereby opening the valve 37. The open valve allows well fluid to flow up through the inlet port 57, past the check ball 43, through the outlet port 58 and into the expanding chamber 40 above the plunger 38. This flow continues until rod 65 and the plunger 38 reaches the bottom of their travel where X is a maximum.

The rod 65 then reverses direction and starts upward. The rod 65 and plunger 38 move upward to decrease the distance X resulting in a decreasing volume chamber 40. The upward movement causes the pressure in the chamber 40 to be higher than below the chamber, thereby closing the traveling check valve 37. On the other hand, pressure in chamber 40 becomes higher below standing check valve 36 than above valve 36, thereby opening valve 36 and causing well fluid to discharge out of the sucker rod pump 30B into the tubing 15.

The upward travel of plunger 38 also causes new well fluid to be drawn into sucker rod pump 30B below the plunger 38 via inlet 33B. When the hydraulic cylinder rod 65 rod again reaches the top of its travel, the valve 36, 37 re-close, as above, and the process repeats. Thus, fluid is transferred from a lower elevation to a higher elevation in repetitive cycles and eventually out the tubing 15 at the surface of the well.

Figure 4:
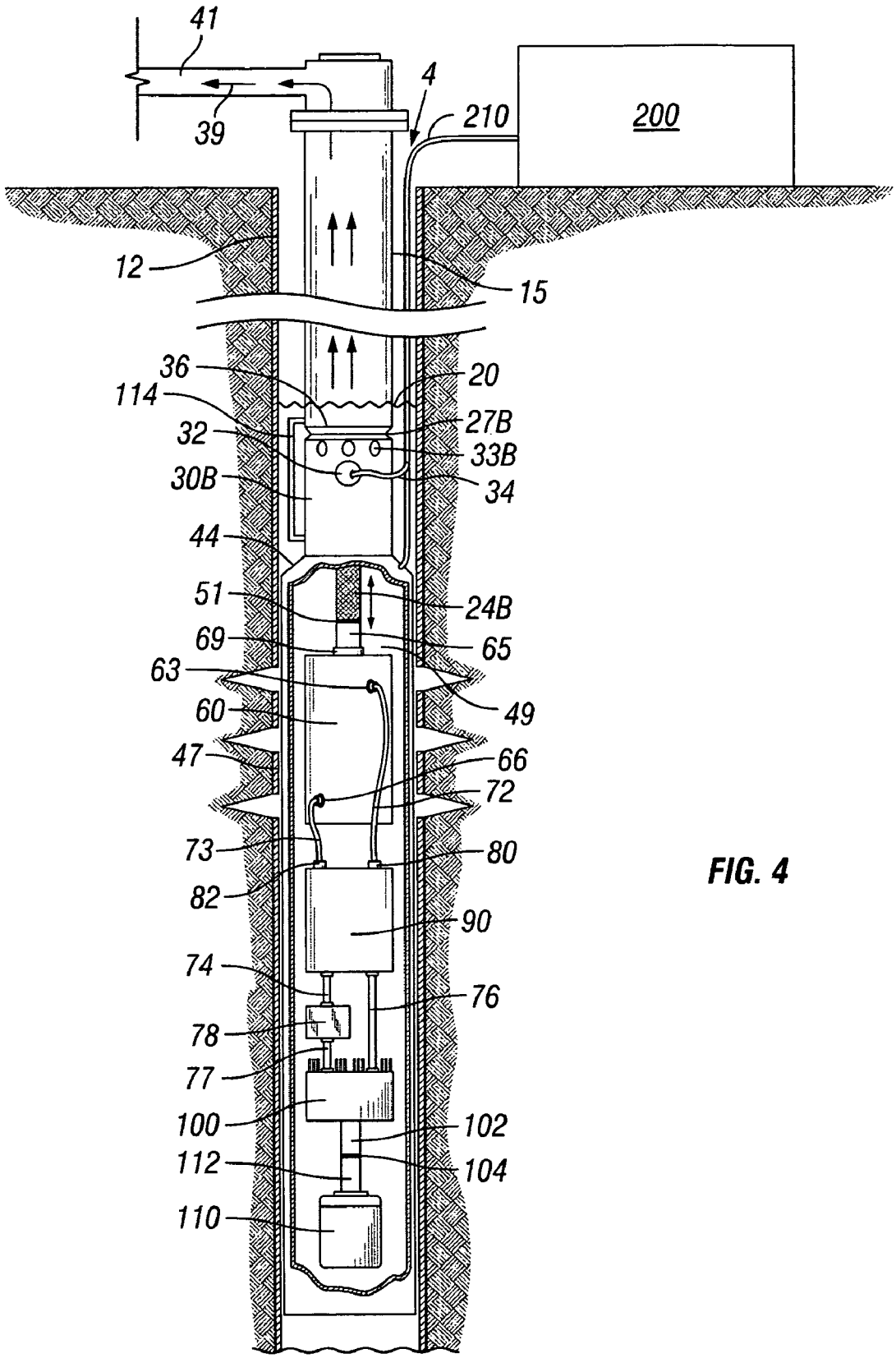
FIG. 4 is a schematic diagram of another embodiment of the pumping system.
Figure 5:
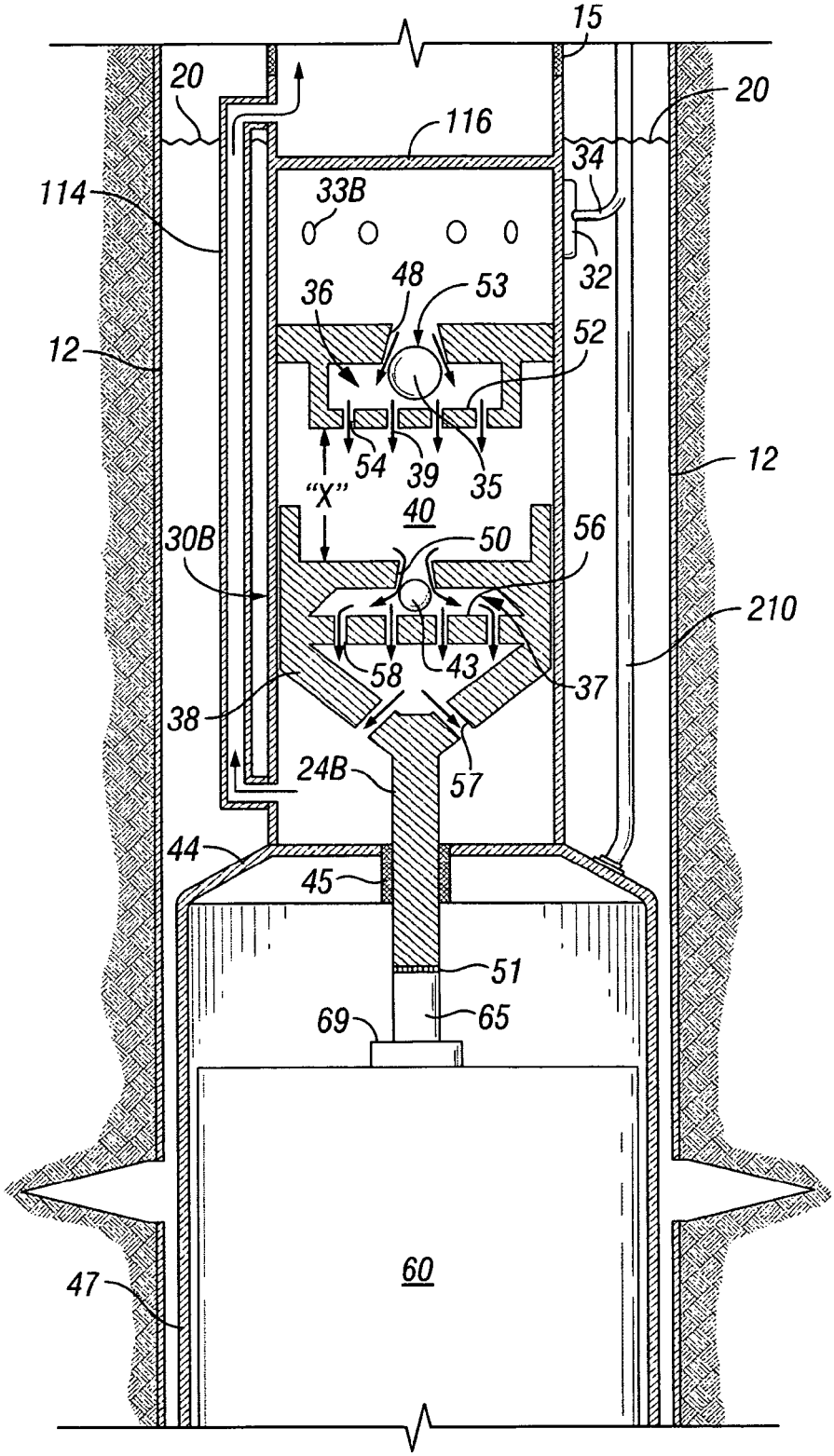
FIG. 5 is a schematic cross-sectional diagram of a portion of the embodiment of the pumping system of FIG. 4, illustrating a rod for a sucker rod pump, one or more valves, and a hydraulic cylinder used to drive the sucker rod pump.

FIG. 4 is a schematic diagram of another embodiment of the pumping system. FIG. 5 is a schematic cross-sectional diagram of a portion of the embodiment of the pumping system of FIG. 4, illustrating a rod for a sucker rod pump, one or more valves, and a hydraulic cylinder used to drive the sucker rod pump. The elements have been described above and are similarly labeled. The two FIGS. will be described in conjunction with each other. In this embodiment, the flow is directed downward through the suction pump, so that the hydraulic cylinder located below the pump is pulling the plunger 38 when the pump is pumping well fluid out of the pump. Therefore, for the exemplary embodiment shown, the flow direction is opposite of the embodiment shown in FIGS. 2 and 3. The rod 24B of the sucker rod pump is attached to the check valve 37 as the traveling valve. The check valves 36, 37 can check fluid in the opposite direction as shown in the embodiment of FIG. 3. The inlet 33B is still position upstream of the check valve 36, but in this embodiment is repositioned to a location above the check valve 36 because of the well fluid flow.

A conduit 114 can fluidicly couple the sucker rod pump 30B to the tubing 15 to allow fluid flow to the surface. Well fluid exiting the pump 30B can be pumped through the conduit 114 and enter the tubing 15 above the pump 30B. A seal 116 can fluidicly seal the inlet of the sucker rod pump from the tubing 15 and the conduit 114 discharge.

In operation, the hydraulic cylinder 60 can push the check valve 37 (traveling valve) upward on an upstroke to reduce the chamber 40 volume. Well fluid in the chamber 40 is restricted from passing through the check valve 36 (standing valve), but can exit the chamber through the check valve 37 to a position downstream of the check valve 37. The hydraulic cylinder then reverses direction and pulls down the check valve 37 on a downstroke, causing fluid downstream of the check valve 37 to be pumped through the conduit 114 into the tubing 15 and eventually to the surface with successive pumping. Well fluid can flow through the check valve 36 from inlet 33B when the check valve 37 is expanding the chamber 40 on the downward pumping stroke to recharge the chamber 40 for the next stroke.

In these exemplary embodiments, the positioning of the hydraulic cylinder (as well as the hydraulic pump and EMC) has been below the elevation of the sucker rod pump 30B. It is to be understood that the hydraulic cylinder (and if desired the hydraulic pump and/or EMC) can be positioned above the pump 30B and the valves 36, 37 reversed in orientation as necessary to accomplish pumping well fluid upward to the surface, as would be known to those with ordinary skill in the art, given the disclosure contained herein.

Figure 6:
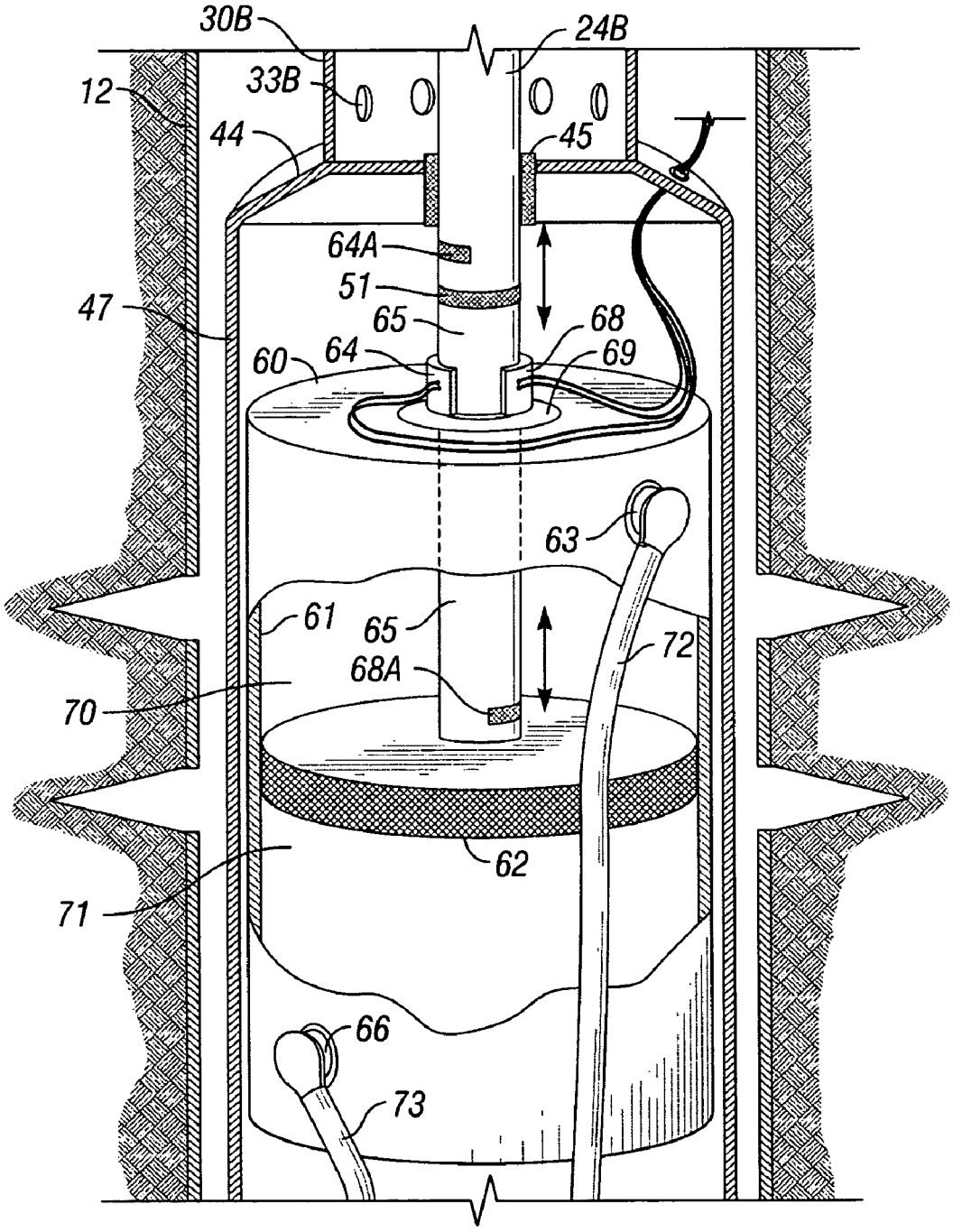
FIG. 6 is a schematic cross-sectional diagram of a hydraulic cylinder for the pumping system.

FIG. 6 is a schematic cross-sectional diagram of a hydraulic cylinder for the pumping system. FIG. 6 illustrates the inner workings of the hydraulic cylinder used to drive the sucker rod pump 30B and the hydraulic fluid lines used to provide the cylinder driving hydraulic fluid. The components have been described above in FIGS. 1-5.

Generally, the system includes a hydraulic cylinder 60 with a rod 65 coupled to a rod 24B of a sucker rod pump 30B, so that linear motion is transmitted therewith. The rod 65 is coupled to a hydraulic cylinder piston 62 that sealingly engages a sidewall 61 of the hydraulic cylinder. The piston 62 translates with linear motion up and down the cylinder wall 61. A conduit 72 is coupled to an upper port 63 in the hydraulic cylinder and a conduit 73 is coupled to a lower port 66. The other ends of the conduits 72, 73 are coupled to other components of the system, as described herein, for providing fluid to the hydraulic cylinder and returning fluid from the cylinder. The particular conduit that is providing fluid depends on whether the piston 62 is moving upward or downward at the time.

In operation, starting at the same point as in FIG. 3, the rod 65 and piston 62 of the hydraulic cylinder 60 are at top of their travel. Hydraulic fluid is pumped under pressure, via hose 72, through the upper port 63 into an upper chamber 70 on top of piston 62. The resulting pressure from the fluid above piston 62 forces piston 62, and hence rod 65, down. Generally, the lower chamber 71 contains hydraulic fluid from a previous cycle. As the piston 62 is pushed down from pressure in the upper chamber, the fluid in the lower chamber exits via hose 73 through lower port 66. This filling action into the upper chamber 70 continues until piston 62 is driven down to the bottom of its prescribed travel.

The bottom of this prescribed travel can be detected with a position sensor 64. The sensor can be disposed at a variety of locations to sense the travel. For example, the sensor 64 can coupled to the cylinder adjacent the exit of the shaft 65. The sensor 64 can also be coupled to the piston 62 at the top and/or bottom of the shaft. The sensor can be any suitable variety, including mechanical, electrical, magnetic, and optical. As merely one non-limiting example, the sensor can sense a change in a magnetic field, such as with a Hall effect transistor. For example, a magnet 64A could be embedded or otherwise coupled to the shaft 65, so that as the shaft moved and the magnet passed the sensor 64, the sensor would conduct an electrical current to signal a change. The sensor 64 can be electrically coupled to the pumping controller 200, shown in FIG. 2 for controlling the movement of the hydraulic cylinder by controlling operation of the manifold 90, the hydraulic pump 100, the EMC 110, or a combination thereof. Further, the sensor 64 and or magnet 64A can be positioned at various heights to sense the piston movement, and therefore provide for varying stroke lengths of the piston in the sensed direction. The various heights can also allow for a predetermined clearance between the lowermost position of the piston in the cylinder.

Once piston 62 is at the bottom of its travel, the process is reversed to raise the piston. Hydraulic fluid is pumped under pressure via conduit 72 through port 66 into the lower chamber 71 below piston 62, thereby forcing piston 62 up. This fluid can continue to flow into the lower chamber 71 until piston 62 is driven up to the top of its prescribed travel. The hydraulic fluid in the upper chamber 70 from a previous cycle is forced out via conduit 72 through top port 63 as the piston 62 travels up. This process repeats, thereby providing the required linear motion.

The top of this prescribed travel can be detected via a position sensor 68. As merely one non-limiting example, the position sensor 68 can be similarly to the position sensor 64, described above, and use a magnet 68A attached to a different portion of the shaft 65 from the magnet 64A, as may be appropriate. In some embodiments, the sensors 64, 68 can be combined into one physical unit. Further, the sensor 68 and or magnet 68A, similar to sensor 64 and sensor 64A, can be positioned at various heights to sense the piston movement, and therefore provide for varying stroke lengths of the piston in the sensed direction. The various positions can also allow for a predetermined clearance between the uppermost position of the piston in the cylinder.

Figure 7:
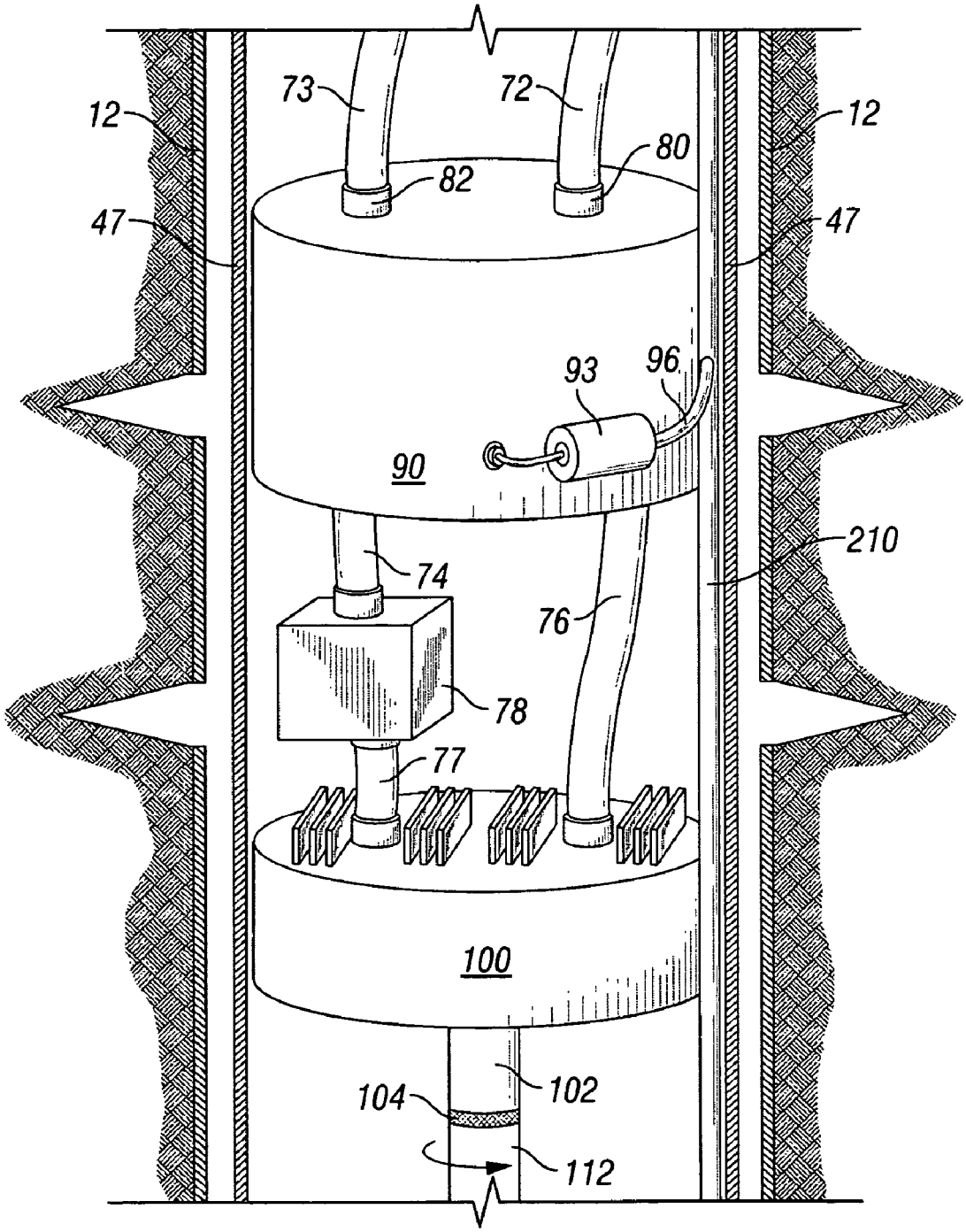
FIG. 7 is a schematic cross-sectional diagram of a hydraulic fluid manifold and a hydraulic pump of the pumping system.

FIG. 7 is a schematic cross-sectional diagram of a hydraulic fluid manifold and a hydraulic pump of the pumping system. Many of the components have been described above. In general, a hydraulic manifold 90 is fluidicly coupled to the hydraulic cylinder 60, described above, through conduits 72, 73. The conduits 72, 73 are coupled to the manifold 90 at ports 80, 82 respectively. The manifold contains switching components, such as valves, and internal porting with passageways to control the flow of hydraulic fluid through the proper conduits 72, 73 coupled to the hydraulic cylinder, depending on which direction of travel is desired. An actuator 93, such as a solenoid or other electrical or mechanical controller, can be coupled to the manifold 90 and interact with the switching components and porting to assist in controlling the fluid flow through the manifold. Such control is known to those with ordinary skill in the art. The actuator 93 can receive its input to determine its actuation from a control cable 96. The cable 96 can be coupled to the cable 210 and communicate with the surface.

A hydraulic pump 100 is fluidicly coupled to the manifold 90 through conduits 74, 76, 77. In one embodiment, conduit 76 is coupled from an outlet port on the hydraulic pump 100 to the manifold 90. The conduits 74, 77 provide a return path from the manifold to the pump 100.

A hydraulic reservoir 78 can be disposed upstream of the hydraulic pump 100 or other appropriate location. The reservoir 78 can function as a buffer to allow hydraulic fluid surges to occur without harming the system and provide sufficient hydraulic fluid to the pump during portions of the pumping cycles. Also shown is the input rotational shaft 102 coupled to an output shaft 112 of the EMC 110, shown in FIG. 2, to provide energy to operate the hydraulic pump. In contrast to some earlier systems, the pump 100 can rotate the same direction even when the flow is reversed through the conduits 72, 73.

In operation, the manifold directs pressurized fluid from the pump 100 into the conduit 72 for a downstroke of the hydraulic cylinder 60, described above, until the piston 62 of the hydraulic cylinder is at the bottom of its prescribed travel. Conduit 73 provides a return path for the discharging hydraulic fluid from the hydraulic cylinder to the manifold and the conduit 74 can provide a return path from the manifold to the reservoir. Once the piston 62 is at the bottom of its travel, the hydraulic manifold 90 reverses flow and provides pressurized fluid into the conduit 73 with the return path through conduit 72.

Figure 8:
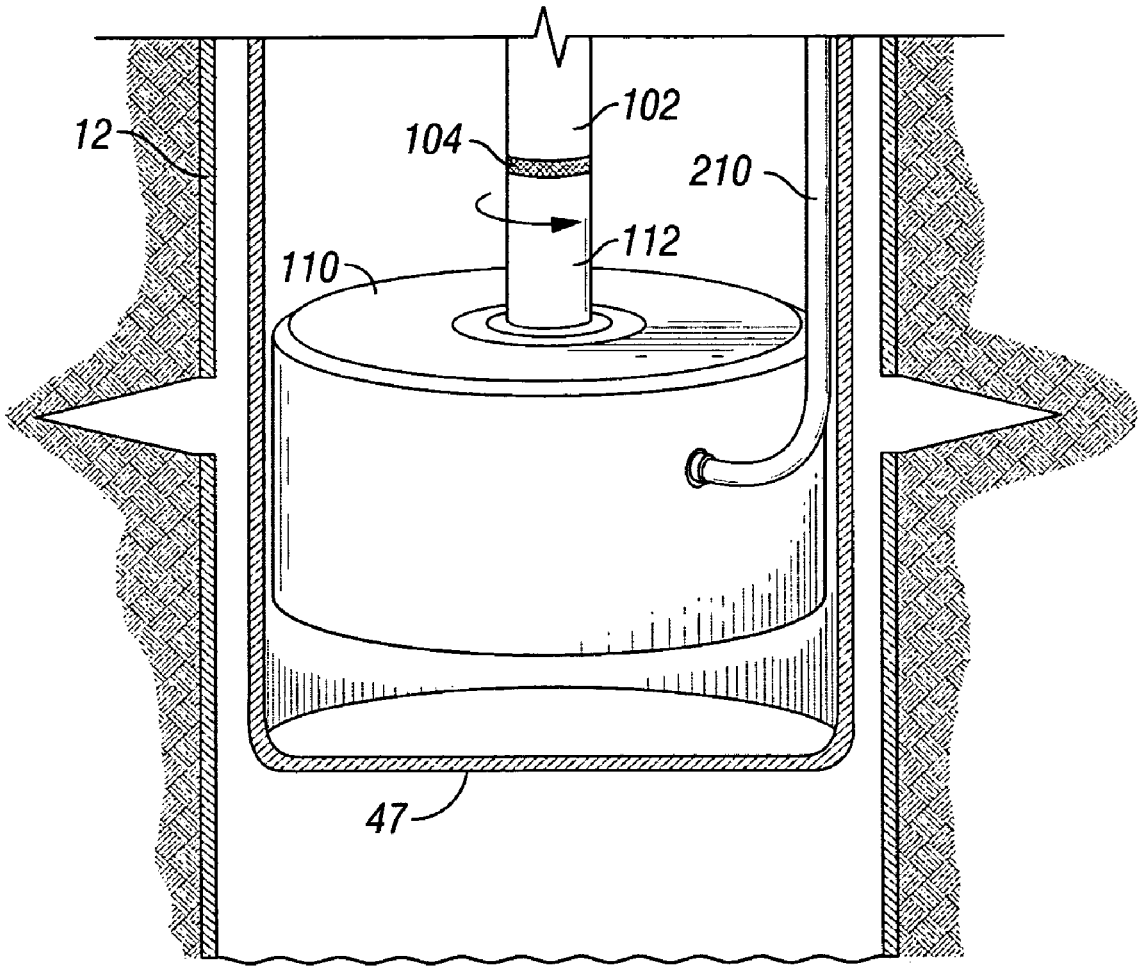
FIG. 8 is a schematic cross-sectional diagram of an electrical to mechanical converter used to provide mechanical input energy to the hydraulic pump.

FIG. 8 is a schematic cross-sectional diagram of an electrical to mechanical converter (EMC) used to provide mechanical input energy to the hydraulic pump. The EMC, such as a motor, is used to provide mechanical input energy to the hydraulic pump, such as by rotating an input shaft on the hydraulic pump. The EMC 110 is coupled to the hydraulic pump 100, shown in FIG. 7. In at least one embodiment, the EMC has an output shaft 112 that provides rotational energy via joiner 104 to the input shaft 102 of the hydraulic pump 100. The electric power to run the EMC 110 is provided from the surface via the power/information cable 210.

Figure 9:
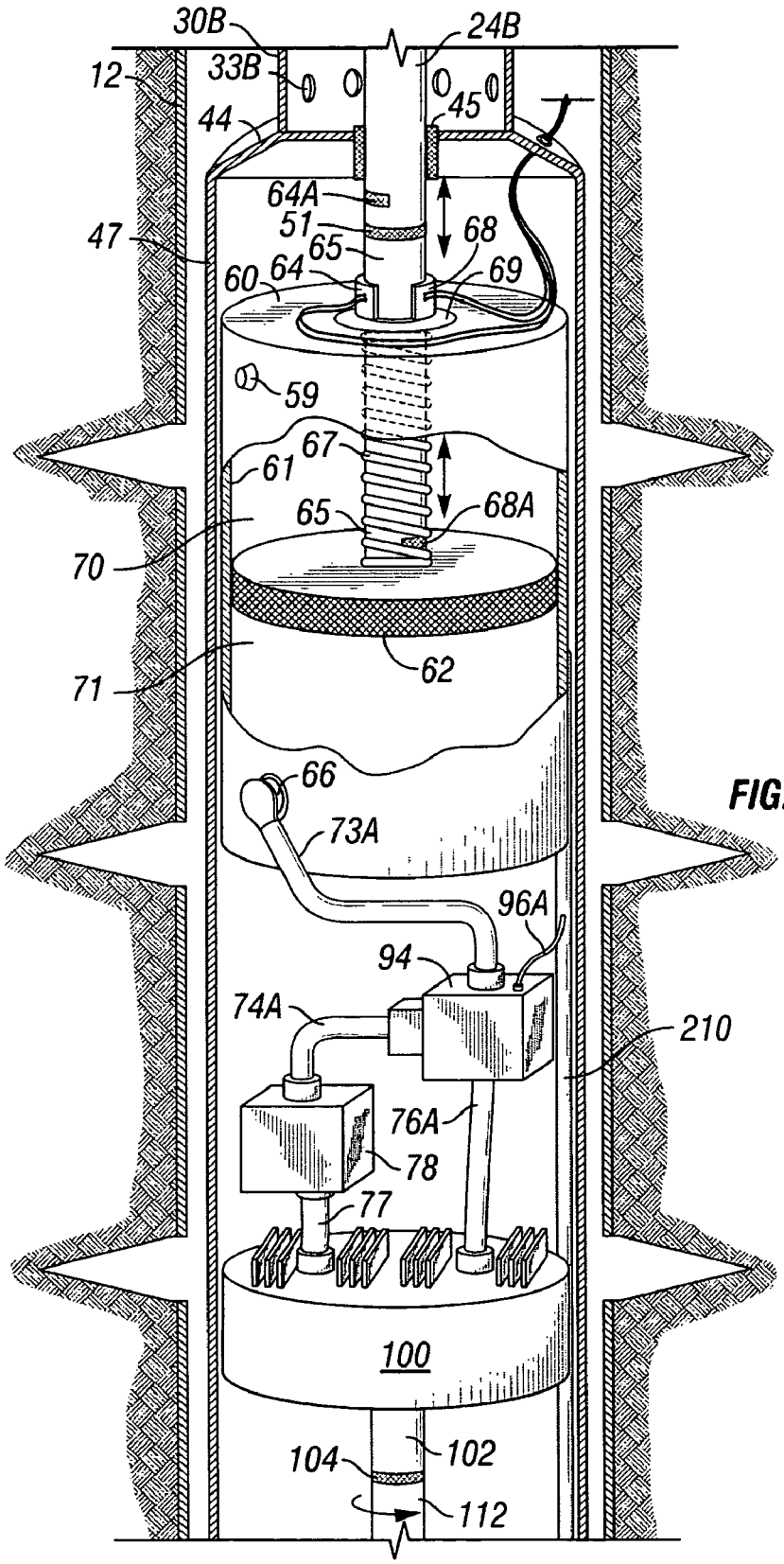
FIG. 9 is a schematic cross-sectional diagram of another embodiment of the pumping system.

FIG. 9 is a schematic cross-sectional diagram of another embodiment of the pumping system. In this embodiment, the pumping system can include a sucker rod pump 30B, a hydraulic cylinder 60, a hydraulic pump 100, and an electrical to mechanical convert 110, shown in FIG. 8. A hydraulic manifold 90, described above, can be functionally replaced by a valve 94.

Advantage can be taken of the fact that, in this orientation, the required force for the downward filling travel of the sucker rod pump's downstroke is relatively small compared to the required force in the sucker rod pump's upstroke to pump the well fluid upward in the well. This embodiment can advantageously use a single acting hydraulic cylinder that only needs pressurization by the hydraulic fluid in one direction, herein the "power stroke" direction (generally the "upstroke" illustrated in FIG. 3 with a larger force), and allow for a return in the "return stroke" direction (generally the "downstroke" illustrated in FIG. 3) by a bias element 67, such as a spring, coupled to the piston 62 and/or rod 65 of the hydraulic cylinder 60.

Use of the bias element 67 can effect replacing the hydraulic manifold 90 with a relatively simple valve 94, such as a bleeder valve. A conduit 73A can fluidicly couple the lower port 66 from the hydraulic cylinder 60 to the valve 94. A conduit 76A can fluidicly couple the valve 94 to the hydraulic pump 100. A conduit 74A can fluidicly couple a port on the valve 94 to the reservoir 78. The valve port can be selectively opened and closed.

In one embodiment, the valve 94 can be activated via voltage from a cable 96A to allow flow of hydraulic fluid between all three hydraulic conduits 73A, 74A, and 76A. When not activated, the valve 94 retains fluidic connection between hydraulic conduits 73A and 76A, but restricts the flow of hydraulic fluid into hydraulic conduit 74A. Alternatively, the valve 94 can be designed to allow flow through the conduits 73A, 74A, and 76A when not activated and not allow flow through the conduit 74A when activated.

In operation, a starting position of the hydraulic cylinder's piston 62 can be the uppermost position of its travel. This position can be detected by sensor 68A. The valve 94 is opened, allowing the hydraulic fluid that had been forced into the hydraulic cylinder's lower chamber 71 to flow back into the hydraulic reservoir 78, via the path of port 66, conduit 73A, valve 94, and through conduit 74A. The force to cause the hydraulic fluid to flow is provided, at least in part, by the energy stored in the compressed bias element 67, which forces the piston 62 downward, thereby shrinking the volume of cylinder's lower chamber 71. This action of the bias element 67 simultaneously brings down the rod 24B, causing the sucker rod pump 30B to fill, as described herein.

While valve 94 is opened, the hydraulic pump 100 may or may not be powered to run. This feature generally would depend on energy and wear considerations. Some classes of hydraulic pumps do not wear well when having their shaft 102 rotation stopped and restarted. If the hydraulic pump 100 is run continuously, its output hydraulic fluid can be returned to the reservoir 78 via the path of conduit 76A, valve 94, and conduit 74A.

With the return spring 67 extended, the piston 62, rod 65, and rod 24B are at their lowest position, as detected by the sensor 64A. The reservoir fluid above the inlet ports can also assist in forcing down the rod 24B. Once the controller 200 receives a signal from the sensor 64A, the controller can deactivate the valve 94, thereby forcing the hydraulic fluid output of the hydraulic pump 100 to flow through the hydraulic conduit 76A, valve 94, hydraulic conduit 73A, and port 66 into the lower chamber 71 of hydraulic cylinder 60. As chamber 71 fills with hydraulic fluid, the fluid causes the assembly, including the piston 62 and the sucker rod 24B, to rise. As the sucker rod 24B rises, it causes the pumping of well fluid. This filling of chamber 71 continues until the plunger 62 is at its highest position, which starts the cycle over.

The upper chamber 70 can be filled with a compressible medium of gas or sponge-like material. In the event that a non-compressible fluid leaks into this upper chamber or the compressible gas becomes overpressurized, unwanted fluid or gas can be expelled via a valve 59 as the piston 62 rises and shrinks the volume of the upper chamber 70. In some embodiments, the valve 59 can be a one-way relief valve that allows fluid to flow out of the piston when the fluid exceeds a preset pressure in the chamber.

Figure 10:
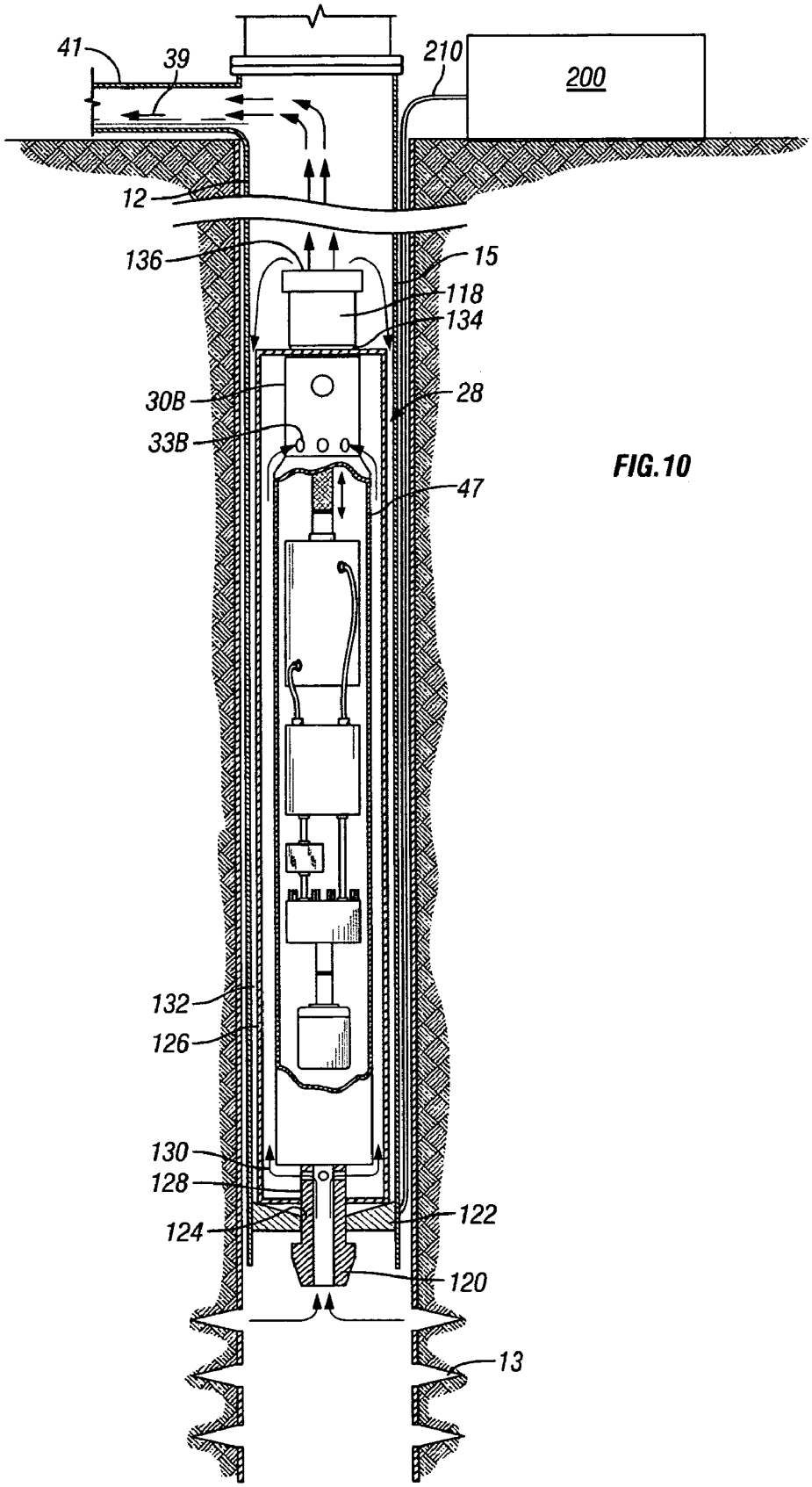
FIG. 10 is a schematic cross-sectional diagram of another embodiment of the pumping system.

FIG. 10 is a schematic cross-sectional diagram of another embodiment of the pumping system. The pumping system 28 includes the sucker rod pump 30B and the enclosure 47 with the various components described above, and additional components illustrated in this figure. This embodiment of the pumping system 28 is sized and disposed inside the tubing 15. The pumping system can be readily retrieved for maintenance or replacement while leaving the tubing 15 intact in the well.

The pumping system generally includes a "fishneck" 118 and a "holddown" 120 coupled with the pumping system 28. For example and without limitation, the fishneck 118 can be coupled to an upper portion and the holddown can be coupled to a lower portion of the pumping system. The fishneck 118 is an attachable oilfield component on which a retrieval tool (not shown, also known as a "fishing tool") engages when retrieving tubing, tools or equipment stuck, lost, or otherwise needing retrieval from a wellbore. The upper end of the fishneck is formed to allow the retrieval tool to temporarily lock into place to retrieve the pumping system 28 to the surface for further servicing. Generally a wireline (also known as a "slick line") is attached to the retrieval tool and inserted inside the tubing to lower the retrieval tool to the fishneck.

Because the pumping system 28 is retrievable, a method of holding the pumping system in position during pumping operations can be used. A seating nipple 122 can coupled to the tubing 15. Although the design can vary, the seating nipple 122 is a component generally fabricated as a short section of heavy wall tubular material with a machined internal surface that provides a seal area 124 and a locking profile. The holddown 120 can have a corresponding shape to engage and removably lock into the seating nipple 122.

The pumping system 28 can further include an additional enclosure 126 useful for maintaining and separating flow paths described herein. The enclosure 126 sealingly separates an inlet 33B of the sucker rod pump from an outlet 136 of the sucker rod pump. The term "enclosure" is used broadly and can include a tubular member separate from the enclosure 47 or an outer portion of the enclosure 47 with flow channels formed therebetween. The enclosure 126 can therefore be sealing engaged in at least one embodiment between the fishneck 118 and the sucker rod pump 33B and be sealingly engaged directly to the seating nipple 122 and its seal area 124 or indirectly through the holddown 120. The enclosure 126 forms a flow area 130 between an outside of the enclosure 47 and an inside of the enclosure 126 used for flowing production fluid to the inlet 33B of the sucker rod pump 30B. The enclosure 126 also forms a flow area 132 between an outside of the enclosure 126 and an inside of the tube 15, where the flow areas 130 and 132 are fluidicly separate.

Figure 11:
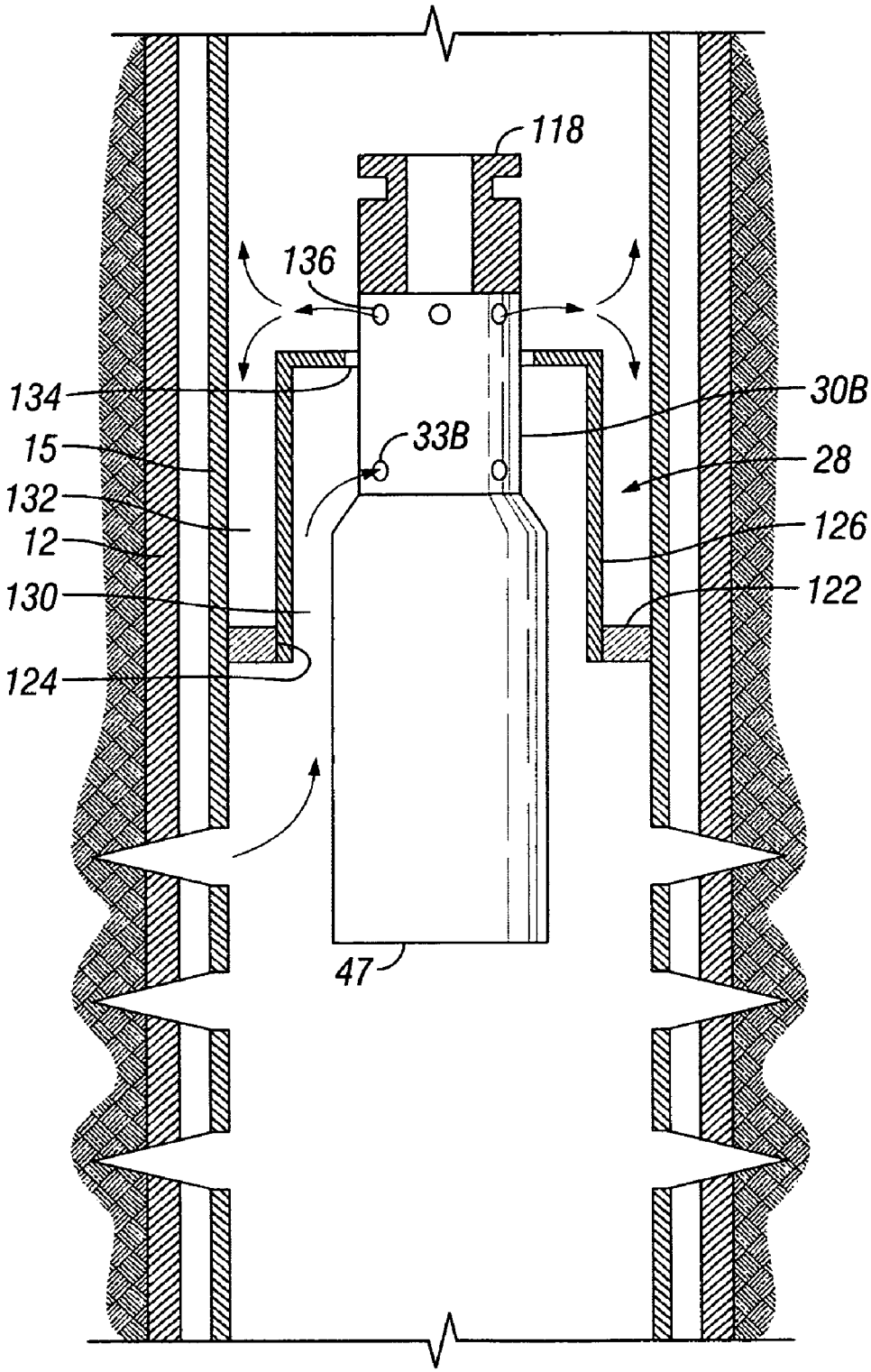
FIG. 11 is a schematic cross-sectional diagram of another embodiment of the pumping system.

Production fluid can enter the well through the perforations 13 formed in the casing and, if necessary, the tube 15. In the embodiment of FIG. 10, the fluid can enter through the holddown 120 and flow through an opening 128 into the flow area 130. The fluid can flow into the inlet 33B, be pumped by the sucker rod pump 30B, and flow out of the outlet 136. The outlet 136 can be formed through the fishneck 118 or through outlet ports formed in the sucker rod (such as shown in FIG. 11.) Fluid can flow down into the flow area 132 until encountering the seal area 124. Other fluid can flow up the tube 15 to the outlet 41.

In at least one embodiment, the cable 210, cable 34 (shown in other figures) and other cables, for connections to the motor, controls, sensors and so forth described herein in prior figures, can be made through the seating nipple 122 to avoid removing the cables during retrieval. The shapes of the fishneck 118, holddown 120, and seating nipple 122 are shown for illustrative purposes and can vary to fulfill the functions of temporarily positioning and holding the pumping system 28 in position and still allowing subsequent retrieval uphole. For example, the holddown can be mechanical, hydraulic, or electrical. Further, the other pumping system embodiments disclosed herein can be configured as similar retrievable pumping system and the particular pumping system in this figure is shown for illustrative purposes only. For example, the sump pump can be located below other elements such as the hydraulic pump. The holddown can be placed at other positions or even excluded.

FIG. 11 is a schematic cross-sectional diagram of another embodiment of the pumping system, illustrative of the principles disclosed in FIG. 10. Similar to the embodiment of FIG. 10, the pumping system 28 includes a fishneck 118, a sucker rod pump 30B having in inlet 33B, an enclosure 47 to separate various hydraulic components from production fluid in the well, an enclosure 126 that separates the sucker rod pump inlet 33B from the outlet 136 of the sucker rod pump, and some component for securing the pumping system at a certain depth, such as the seating nipple 122. In this embodiment, the enclosure 126 is sealingly engaged with the seating nipple and can be modified in shape as necessary to form the sealing engagement and, in some embodiments, anchor the pumping system in position in the well. The enclosure 126 is sealingly engaged between the sucker rod pump inlet and outlet by any suitable method including use of a seal 134 therebetween, by directly coupling such as welding, or other methods.

Production fluid can enter the well through the perforations 13 formed in the casing 12 and, if necessary, the tube 15. The fluid can enter into the flow area 130, separated from the flow area 132. The fluid can flow into the inlet 33B, be pumped by the sucker rod pump 30B, and flow out of the outlet 136. Fluid can flow down into the flow area 132 until encountering the seal area 124. Other fluid can flow up the tube 15 to the outlet 41.

While the foregoing is directed to various embodiments of the present invention, other and further embodiments may be devised without departing from the basic scope thereof. Other embodiments within the scope of the claims herein will be apparent to one skilled in the art from consideration of the specification and practice of the invention as disclosed herein. For example, various other linear displacement pumps can be used in the system. It is intended that the specification, together with the example, be considered exemplary only, with the scope and spirit of the invention being indicated by the claims that follow.

The various methods and embodiments of the invention can be included in combination with each other to produce variations of the disclosed methods and embodiments, as would be understood by those with ordinary skill in the art, given the understanding provided herein. Also, various aspects of the embodiments could be used in conjunction with each other to accomplish the understood goals of the invention. Also, the directions such as "top," "bottom," "left," "right," "upper," "lower," and other directions and orientations are described herein for clarity in reference to the figures and are not to be limiting of the actual device or system or use of the device or system. Unless the context requires otherwise, the word "comprise" or variations such as "comprises" or "comprising", should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. Further, the order of steps can occur in a variety of sequences unless otherwise specifically limited. The various steps described herein can be combined with other steps, interlineated with the stated steps, and/or split into multiple steps. Additionally, the headings herein are for the convenience of the reader and are not intended to limit the scope of the invention.

Further, any references mentioned in the application for this patent as well as all references listed in the information disclosure originally filed with the application are hereby incorporated by reference in their entirety to the extent such may be deemed essential to support the enabling of the invention. However, to the extent statements might be considered inconsistent with the patenting of the invention, such statements are expressly not meant to be considered as made by the Applicants.

The invention claimed is:

1. A system for pumping well fluid to an upper surface of a well, comprising:

a. a sucker rod pump;

b. a hydraulic cylinder coupled to the sucker rod pump and adapted to impart linear motion to the sucker rod pump;

c. a hydraulic pump coupled to the hydraulic cylinder and adapted to provide hydraulic fluid to the hydraulic cylinder; and d. an electrical to mechanical converter (EMC) coupled to the hydraulic pump and adapted to provide input power to the hydraulic pump, at least the hydraulic cylinder being disposed downhole with the sucker rod pump and adapted to operate the sucker rod pump independent of a sucker rod extending down from a surface pumping unit.

2. The system of claim 1, further comprising a hydraulic manifold coupled to the hydraulic pump and adapted to direct hydraulic fluid flow to selectable ports on the hydraulic cylinder.

3. The system of claim 1, further comprising a valve coupled between the hydraulic pump and the hydraulic cylinder and adapted to selectively allow a first flow from an output of the hydraulic pump into the hydraulic cylinder and a second flow from the hydraulic cylinder into the hydraulic pump.

4. The system of claim 2, further comprising an actuator coupled to the hydraulic manifold and adapted to actuate the hydraulic manifold to direct the hydraulic fluid flow.

5. The system of claim 4, further comprising a cable coupled to one or more components of the system to control the operation of the components.

6. The system of claim 1, further comprising a hydraulic fluid reservoir coupled to an inlet of the hydraulic pump.

7. The system of claim 1, further comprising a tubing coupled to the sucker rod pump to allow well fluid from the sucker rod pump to flow to the upper surface of the well.

8. The system of claim 7, wherein the EMC, the hydraulic pump, the hydraulic cylinder or a combination thereof can be retrieved from a downhole position in the well independent of removing the tubing from the well.

9. The system of claim 1, wherein the sucker rod pump comprises a check valve adapted to allow fluid to exit the pump in a discharge direction while the fluid is restricted from exiting the pump in an entering direction.

10. The system of claim 1, wherein the sucker rod pump is installed downhole in the well at an elevation to allow well fluid in the well to enter a sucker rod pump inlet.

11. The system of claim 10, further comprising a cable disposed downhole in the well and coupled to the EMC.

12. The system of claim 1, further comprising an enclosure coupled to the sucker rod pump.

13. The system of claim 1, further comprising a well fluid sensor coupled to the sucker rod pump and adapted to sense well fluid level, pressure, or a combination thereof.

14. The system of claim 1, further comprising a position sensor coupled to the hydraulic cylinder and adapted to sense a position of a rod from the hydraulic cylinder.

15. A well in which the sucker rod pump of claim 1 is installed.

16. The system of claim 1, wherein well fluid comprises oil, water, or a combination thereof.

17. The system of claim 1, further comprising a pump controller adapted to control the hydraulic cylinder.

18. A system for pumping well fluid to an upper surface of a well, comprising:

a. a linear displacement pump;

b. a hydraulic cylinder coupled to the linear displacement pump and adapted to impart reversible linear motion to the linear displacement pump; and c. a hydraulic pump coupled to the hydraulic cylinder and adapted to provide hydraulic fluid to the hydraulic cylinder, at least the hydraulic cylinder being disposed downhole with the linear displacement pump and adapted to impart the reversible linear motion to the linear displacement pump independent of a sucker rod extending down from a surface pumping unit.

19. The system of claim 18, further comprising an LMC coupled to the hydraulic pump and adapted to provide input power to the hydraulic pump.

20. The system of claim 18, further comprising a hydraulic manifold coupled to the hydraulic pump and adapted to direct hydraulic fluid flow to selectable ports on the hydraulic cylinder to impart the reversible linear motion from the hydraulic cylinder.

21. The system of claim 18, further comprising a valve coupled between the hydraulic pump and the hydraulic cylinder and adapted to selectively allow a first flow from an output of the hydraulic pump into the hydraulic cylinder and a second flow from the hydraulic cylinder into the hydraulic pump.

22. The system of claim 20, further comprising a power information cable coupled to one or more components of the system to control the operation of the components.

23. The system of claim 18, further comprising a hydraulic fluid reservoir coupled to an inlet of the hydraulic pump.

24. The system of claim 18, further comprising a well fluid sensor coupled to the sucker rod pump and adapted to sense well fluid level, pressure, or a combination thereof.

25. The system of claim 18, further comprising a position sensor coupled to the hydraulic cylinder and adapted to sense a position of a rod from the hydraulic cylinder.

26. A well comprising the linear displacement pump of claim 18.

27. The system of claim 18, further comprising a pump controller adapted to control the hydraulic cylinder.

28. The system of claim 18, further comprising a bias element coupled to the rod of the hydraulic cylinder to bias the rod in a returned position.

29. The system of claim 18, further comprising a tubing coupled to the linear displacement pump to allow well fluid from the linear displacement pump to flow to the upper surface of the well.

30. The system of claim 29, wherein the linear displacement pump, the hydraulic cylinder, and the hydraulic pump can be retrieved from a downhole position in the well independent of removing the tubing from the well.

31. A process for pumping well fluid to an upper surface of a well with a linear displacement pump, a hydraulic cylinder having a rod coupled to the linear displacement pump, a hydraulic pump coupled to the hydraulic cylinder, and an electrical to mechanical converter (EMC) coupled to the hydraulic pump, comprising:

a. allowing the well fluid into the linear displacement pump;

b. actuating the EMC to provide mechanical energy to the hydraulic pump;

c. pumping hydraulic fluid with the hydraulic pump into a first port on the hydraulic cylinder to cause a piston in the hydraulic cylinder to move the hydraulic cylinder rod;

d. opening a first valve of the linear displacement pump to allow well fluid to flow into a pump chamber of the linear displacement pump by movement of the hydraulic cylinder rod; and e. opening a second valve of the linear displacement pump to allow well fluid to flow out of the pump chamber of the linear displacement pump by movement of the hydraulic cylinder rod while restricting discharge of the well fluid through the first valve, at least the hydraulic cylinder being disposed downhole with the linear displacement pump and imparting a reversible linear motion to the linear displacement pump independent of a sucker rod extending down from a surface pumping unit.

32. The process of claim 31, further comprising moving the hydraulic cylinder rod in a first direction to open the first valve, and reversing the hydraulic cylinder rod movement to a second direction to open the second valve.

33. The process of claim 32, wherein the second direction closes the first valve while the second valve is open.

34. The process of claim 32, further comprising a hydraulic manifold coupled to the hydraulic cylinder and further comprising controlling the reversing hydraulic cylinder rod movement with the hydraulic manifold.

35. The process of claim 31, further comprising allowing a first flow of fluid from the hydraulic pump through a valve into the hydraulic cylinder to cause a piston in the hydraulic cylinder to move in a first direction and allowing a second flow of fluid from the hydraulic cylinder through the valve into the hydraulic pump when the piston in the hydraulic cylinder moves in a second direction.

36. The process of claim 31, further comprising accepting fluid from a second port on the hydraulic cylinder while pumping the hydraulic fluid into the first port.

37. The process of claim 31, further comprising sensing the hydraulic cylinder rod movement to control the linear displacement pump.

38. The process of claim 31, controlling the movement of the hydraulic cylinder with a pump controller.

39. The process of claim 31, further comprising forming a well into which the linear displacement pump is installed.

40. The process of claim 39, further comprising installing the linear displacement pump into the well.

41. The process of claim 40, wherein the well comprises a tubing coupled to the linear displacement pump to allow fluid to be pumped to the upper surface and further comprising allowing selectable retrieval of the linear displacement pump, the hydraulic cylinder, the hydraulic pump, and the EMC, independent of the tubing.

42. A system for pumping well fluid to an upper surface of a well, comprising:

a. a sucker rod pump;

b. a hydraulic cylinder coupled to the sucker rod pump and adapted to impart linear motion to the sucker rod pump;

c. a hydraulic pump coupled to the hydraulic cylinder and adapted to provide hydraulic fluid to the hydraulic cylinder;

d. an electrical to mechanical converter (EMC) coupled to the hydraulic pump and adapted to provide input power to the hydraulic pump; and e. a tubing coupled to the sucker rod pump to allow well fluid from the sucker rod pump to flow to the upper surface of the well, wherein the EMC, the hydraulic pump, the hydraulic cylinder or a combination thereof can be retrieved from a downhole position in the well independent of removing the tubing from the well.

43. A system for pumping well fluid to an upper surface of a well, comprising:

a. a sucker rod pump;

b. a hydraulic cylinder coupled to the sucker rod pump and adapted to impart linear motion to the sucker rod pump;

c. a hydraulic pump coupled to the hydraulic cylinder and adapted to provide hydraulic fluid to the hydraulic cylinder;

d. an electrical to mechanical converter (EMC) coupled to the hydraulic pump and adapted to provide input power to the hydraulic pump; and e. a cable disposed downhole in the well and coupled to the EMC, wherein the sucker rod pump is installed downhole in the well at an elevation to allow well fluid in the well to enter a sucker rod pump inlet.

44. The system of claim 43, further comprising an enclosure coupled to the sucker rod pump.

45. A system for pumping well fluid to an upper surface of a well, comprising:

a. a sucker rod pump;

b. a hydraulic cylinder coupled to the sucker rod pump and adapted to impart linear motion to the sucker rod pump;

c. a hydraulic pump coupled to the hydraulic cylinder and adapted to provide hydraulic fluid to the hydraulic cylinder;

d. an electrical to mechanical converter (EMC) coupled to the hydraulic pump and adapted to provide input power to the hydraulic pump; and e. a well fluid sensor coupled to the sucker rod pump and adapted to sense well fluid level, pressure, or a combination thereof.

46. A system for pumping well fluid to an upper surface of a well, comprising:

a. a linear displacement pump;

b. a hydraulic cylinder coupled to the linear displacement pump and adapted to impart reversible linear motion to the linear displacement pump;

c. a hydraulic pump coupled to the hydraulic cylinder and adapted to provide hydraulic fluid to the hydraulic cylinder; and d. a well fluid sensor coupled to the sucker rod pump and adapted to sense well fluid level, pressure, or a combination thereof.

47. A system for pumping well fluid to an upper surface of a well, comprising:

a. a linear displacement pump;

b. a hydraulic cylinder coupled to the linear displacement pump and adapted to impart reversible linear motion to the linear displacement pump;

c. a hydraulic pump coupled to the hydraulic cylinder and adapted to provide hydraulic fluid to the hydraulic cylinder; and d. a bias element coupled to the rod of the hydraulic cylinder to bias the rod in a returned position.

48. A system for pumping well fluid to an upper surface of a well, comprising:

a. a linear displacement pump;

b. a hydraulic cylinder coupled to the linear displacement pump and adapted to impart reversible linear motion to the linear displacement pump;

c. a hydraulic pump coupled to the hydraulic cylinder and adapted to provide hydraulic fluid to the hydraulic cylinder; and d. a tubing coupled to the linear displacement pump to allow well fluid from the linear displacement pump to flow to the upper surface of the well, wherein the linear displacement pump, the hydraulic cylinder, and the hydraulic pump can be retrieved from a downhole position in the well independent of removing the tubing from the well.

49. A process for pumping well fluid to an upper surface of a well with a linear displacement pump, a hydraulic cylinder having a rod coupled to the linear displacement pump, a hydraulic pump coupled to the hydraulic cylinder, and an electrical to mechanical converter (EMC) coupled to the hydraulic pump, the well having a tubing coupled to the linear displacement pump to allow fluid to be pumped to the upper surface, the process comprising:

a. forming a well;

b. installing the linear displacement pump into the well;

c. allowing the well fluid into the linear displacement pump;

d. actuating the EMC to provide mechanical energy to the hydraulic pump;

e. pumping hydraulic fluid with the hydraulic pump into a first port on the hydraulic cylinder to cause a piston in the hydraulic cylinder to move the hydraulic cylinder rod;

f. opening a first valve of the linear displacement pump to allow well fluid to flow into a pump chamber of the linear displacement pump by movement of the hydraulic cylinder rod;

g. opening a second valve of the linear displacement pump to allow well fluid to flow out of the pump chamber of the linear displacement pump by movement of the hydraulic cylinder rod while restricting discharge of the well fluid through the first valve; and h. allowing selectable retrieval of the linear displacement pump, the hydraulic cylinder, the hydraulic pump, and the EMC, independent of the tubing.

* * * * *